United States Patent [19]

Ortmanns et al.

[11] 4,178,728

[45] Dec. 18, 1979

[54] FIRE-PROOF WINDOW

[75] Inventors: Gunther Ortmanns; Franz Kraemling, both of Aachen; Siegfried Pikhard, Roetgen, all of Fed. Rep. of Germany

[73] Assignee: Saint-Gobain Industries, Neuilly-sur-Seine, France

[21] Appl. No.: 857,417

[22] Filed: Dec. 5, 1977

[30] Foreign Application Priority Data

Dec. 3, 1976 [DE] Fed. Rep. of Germany ..... 2654776

[51] Int. Cl.[2] ..... E04C 2/00

[52] U.S. Cl. ..... 52/232; 52/308

[58] Field of Search ..... 52/232, 202, 207, 307, 52/308, 616, 397, 398; 49/1-5

[56] References Cited

U.S. PATENT DOCUMENTS

| | | | |
|---|---|---|---|
| 816,241 | 3/1906 | Miller | 49/4 |
| 3,411,247 | 11/1968 | Fleming | 52/616 |

FOREIGN PATENT DOCUMENTS

| | | | |
|---|---|---|---|
| 1852959 | 2/1962 | Fed. Rep. of Germany . | |
| 1900054 | 6/1970 | Fed. Rep. of Germany . | |
| 2328737 | 12/1974 | Fed. Rep. of Germany . | |
| 2344459 | 4/1975 | Fed. Rep. of Germany . | |
| 2527134 | 12/1976 | Fed. Rep. of Germany . | |
| 2243318 | 4/1975 | France | 52/203 |

*Primary Examiner*—James L. Ridgill, Jr.
*Attorney, Agent, or Firm*—Pennie & Edmonds

[57] ABSTRACT

This invention relates to a highly effective fire-proof window consisting of at least one glass sheet mounted in a frame, the frame being such that when the glass sheet is exposed to the effect of heat in a fire, it will be subjected to a somewhat uniform heat effect thus preventing breakage due to the buildup of stresses. Uniform heating is produced by the inclusion of a covering along the edge of the glass which falls away upon heating of the window.

12 Claims, 4 Drawing Figures

Fig. 1
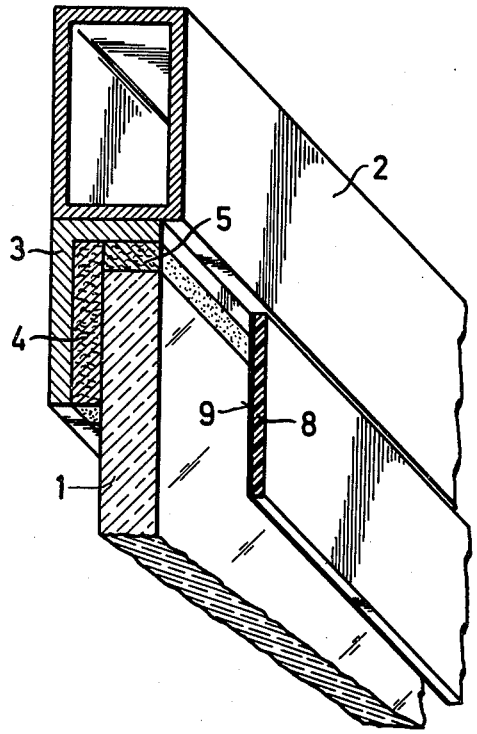
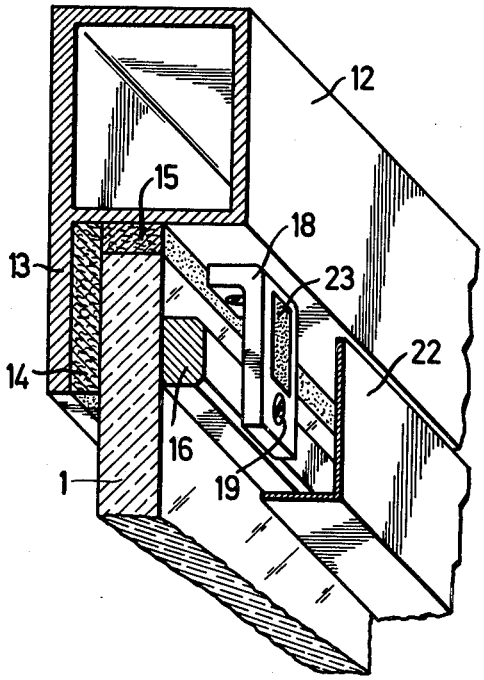
Fig. 2

Fig. 3
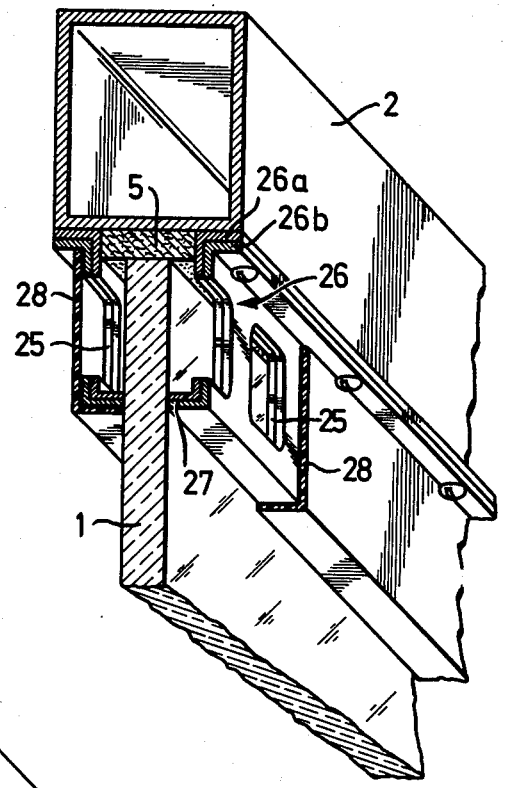
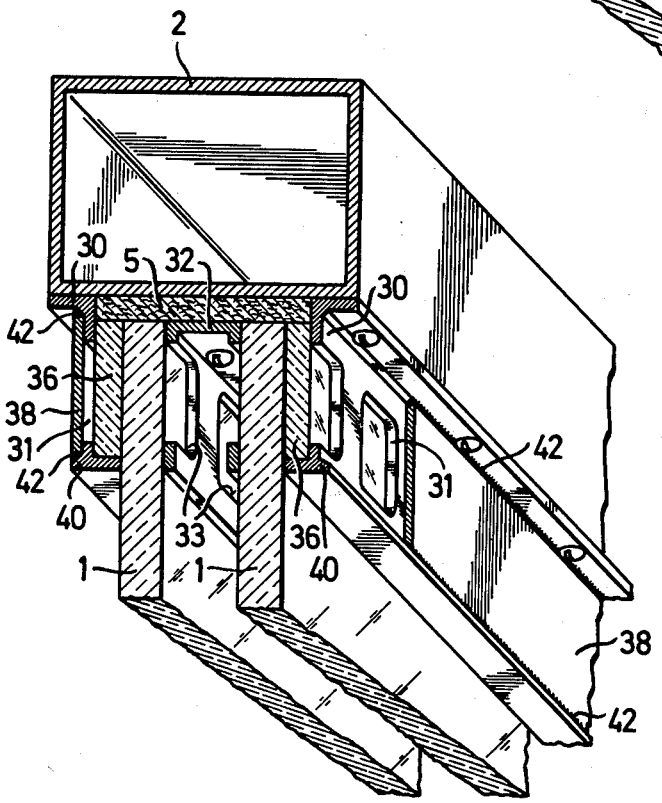
Fig. 4

FIRE-PROOF WINDOW

BACKGROUND OF THE INVENTION

Windows constructed to withstand the effects of fire without premature breakage are generally known. Examples of such windows are described in German Auslegungsschrifts Nos. 2,328,737 and 2,344,459 and German application No. 2,527,134. In a fire, the glass sheet or pane of a conventional window unit is subjected to uneven heating because its edge is enclosed in the window frame and therefore not heated at the same rate as the center region of the sheet. As a result, stresses resulting from expansion occur in the edge region of the sheet and lead to rupture of the window. In the prior art constructions described in the above-mentioned patents, provisions have been made for decreasing the temperature gradient between the center of the glass sheet and its edge region. Generally, this is accomplished by leaving the edge of the glass sheet exposed, or at least partially exposed, on the side of the window unit which may be subjected to the effects of fire. Other constructions involve the use of protective glass placed on the fireside of the silicate glass or the use of glass which itself is specially constructed to resist the effects of fire.

SUMMARY OF THE PRESENT INVENTION

In accordance with the teachings of the present invention, a fire-proof window unit is constructed with a normal silicate glass sheet or sheets and the edges of the sheets are covered to give the appearance of being connected into the window frame. The covering for the edges of the glass sheets is in the form of a listel which is self-removing under the effect of fire.

In the case where a sheet of silicate glass is held in place in the window frame by an angle bar on the side which will not be exposed to the effect of fire, the listel is arranged against the edge of the face of the glass sheet subjected to fire and is secured either in direct contact with the glass sheet or with interposition of a fastening means.

According to another embodiment, cushion frames are provided in order to hold the glass sheet in the window frame. These cushion frames bear on the face of the glass sheet exposed to the effect of fire at a distance spaced from its edges. The cushion frames are held in place by T-squares arranged at various intervals and the listels are fastened onto the T-squares and/or onto the cushion frames themselves.

In still another embodiment, perforated metal cushion frames are provided in order to fasten the silicate glass sheet on the side exposed to the fire. Listels are then fastened to the outer surface of the cushion frames.

In each of the above constructions, the listels are constructed of a material which is readily combustible and thus self-destructing when exposed to the heat of fire. Fire tests have shown that the fire resistance time of the window panes constructed according to the invention is not substantially less than that of known fire-proof window panes provided the listel is eliminated quickly enough. For example, in the case of a window pane size of 140×120 cm., the listel burns away six minutes at the latest after exposure to the effect of fire. Under this condition, its presence in the initial phase of the fire is not enough to create a sufficient temperature gradient between the center and the edges of the glass sheet which would give rise to stresses that might lead to the premature rupturing of the sheet. When the edge of the glass sheet is subsequently uncovered upon the removal of the listel, the temperature across the glass sheet quickly becomes equalized and the initial stresses disappear.

According to the above-described embodiments of the invention, the listels are completely eliminated simply because they consist of an inflammable material. In order to rapidly free all the edges of the window pane, materials which are relatively easy to ignite are used. These materials are also preferably ones which burn rapidly without emitting many flames and which leave the smallest possible amounts of residue. Satisfactory results are obtained, for example, when celluloids are used.

A listel which ignites spontaneously and which even gives off heat when burning provides an advantageous effect. In particular, the heat created subjects the edge of the glass sheet to additional heating. It is thus raised to a temperature which is higher than that of the center of the window pane and compression stresses are even created therein which efficiently improve fire resistance. In the case of insulated windows with multiple panes, it is possible to fill the edge space between the silicate glass sheets with a substance undergoing exothermic combustion which ignites in case of fire and gives rise to a similar effect.

Another solution which makes it possible to reach the object of the present invention consists in covering the silicate glass sheet, in the frame area, with a listel made of metal. The listel is connected to either the glass sheet or the frame by means which loses its efficiency under the effect of heat.

According to this embodiment, an adhesive can be used. For example, a thermofusible adhesive, which gives way under the effect of heat is suitable. With such a construction each listel breaks loose under its own weight as soon as the adhesive stops fulfilling its function. In a particularly advantageous manner, the adhesive is a low melting solder having a soft soldering the melting point which ranges from 100° to 180° C.

BRIEF DESCRIPTION OF THE DRAWINGS

FIG. 1 is a partial perspective view showing an embodiment of the present invention in which the glass sheet is fastened only on its edge and on one face, the face designed to resist the effect of fire being free and simply covered with a listel;

FIG. 2 is a partial perspective view showing an embodiment in which the glass sheet is maintained on the fire resisting side by a listel spaced from the edge of the glass and masked by an angle bar shaped listel;

FIG. 3 is a partial perspective view showing an embodiment in which the glass sheet is fastened on both its faces through a perforated cushion frame which is itself covered with a combustible listel; and FIG. 4 is a partial perspective view showing an embodiment for a double window where the perforated cushion frames are masked with metallic listels which detach under the effect of heat.

DETAILED DESCRIPTION OF THE PREFERRED EMBODIMENTS

The constructions shown in FIGS. 1 and 2 of the drawings are adapted to resist flames or heat on only one of their faces. With the constructions of FIGS. 3 and 4, however, fire is resisted from both sides. The one-way constructions break relatively quickly when subjected to a fire on the opposite face. Such a mode of construction is advantageous for incorporation into the facades of high buildings where, in principle, it is necessary to prevent the penetration of flames from the outside while ensuring that the opening will be freed if fire comes from the inside.

The window shown in FIG. 1 comprises a hardened silicate glass sheet 1 placed in a frame 2 consisting of a rectangular metallic tube. Frame 2 is fastened into the wall in the usual manner and supports an angle bar 3 on its face turned towards the bay. The angle bar 3 is made of steel or other metal having a high melting point.

Between glass sheet 1 and the grooved bottom, defined by the angle bar 3, lining strips 4 and 5 are positioned. These strips are made of an insulating material such as asbestos and fastened to the frame and glass sheet 1 by a heat resistant glue. On the fire resistant side of the window, the glass sheet 1 is covered only on its rim by a covering in the form of a listel 8 which is fastened directly thereto by a layer of glue 9. The width of the listel 8 is the same as that of the exposed face of the opposite angle bar 3. This listel consists of an easily combustible material such as celluloid which burns rather quickly and without carbonization. Its surface appearance is made to be similar to that of angle bar 3 so as to form a uniform assembly.

The window shown in FIG. 2 comprises a hardened silicate glass sheet placed in the groove of a frame 12 consisting of metallic sections each of which consists of a square tube carrying a flange 13 on which glass sheet 1 bears through an insulating material strip 14. In addition, an insulating material strip 15 is placed between the edge of glass sheet 1 and frame 12.

On the face of the glass sheet opposite that which rests on flange 13, a cushion frame is employed to fasten the sheet to the frame 12. The cushion frame consists of a narrow metallic rod 16 placed at a distance from the edge of the glass sheet so that its marginal region is not covered and protected from heat. Rod 16 is fastened through T-squares 18 screwed onto the frame 12. The T-squares carry locking screws 19 for pressing the rod against the glass sheet 1. These T-squares are sufficiently spaced apart so as not to form a substantial screen against heat. A metallic listel 22 shaped as an angle bar covers rod 16 and T-squares 18 onto which it is fastened through a layer of glue 23. This glue has the property of softening at a temperature of 100° C. and of thus losing its properties of adherence so that listel 22 falls and frees the edge or rim of the pane as soon as it is exposed to the effect of fire. Listel 22 can, for example, consist of an aluminum section having the same appearance as the other parts of the metallic frame.

As shown in FIG. 3, the frame 2 again consists of a square, hollow steel section integral with the masonry. Cushion frames 26 are fastened to the frame 2 on either side of glass sheet 1. Both of the frames 26 are provided with openings 25 and are arranged in a direction parallel to the glass sheet but spaced therefrom by several millimeters. The frames 26 also have bent flanges 27 which bear on the faces of the glass sheet at a distance from its edge on the order of 10 to 20 mm. When exposed to the effect of fire, the marginal region of the glass sheet 1 receives, through the openings 25, sufficient heat so that no stresses appear which might induce rupture. An asbestos insulating strip 5 is interposed between the edge of sheet 1 and frame 2.

In construction, both cushion frames 26 consist of two thicknesses having different coefficients of expansion. The material in the inner layer 26*a* has a lower coefficient of expansion than that of the material in the external layer 26*b* so that when heated, they behave as a bimetallic strip and pinch the edge of the glass sheets. As a result, when the latter begins to soften, it is solidly maintained and cannot collapse.

A listel 28 shaped as a T-square made of an easily inflammable material is glued to the exterior of each cushion frame 26 in order to mask its openings. The openings are quickly freed at the beginning of a fire as a result of the combustion of the listel.

FIG. 4 shows a double window in which the two glass sheets 1 are separated by cross-pieces 32. On their external faces, the glass sheets 1 are fastened in place by Z-shaped cushion frames 30, screwed onto frame 2 and provided over their entire length with openings 31 through which the flames and heat radiation can reach the edge of the glass sheets.

Cross-pieces 32 have a U-shaped profile and are also provided with ports 33 facing ports 31. An asbestos strip 5 is placed between the edge of the glass sheets and the frame 2. This prevents cooling of the marginal region of the glass sheets by conduction through the frame.

A glass strip 36 is positioned between each of the cushion frames 30 and the adjacent glass sheet 1. The purpose of the glass strip is to improve the holding of glass sheets 1 as they begin to soften in a fire. Although strips also soften, this causes them to adhere to the glass sheet 1; and since the strips are retained by the bent flange of cushion frame 30, the sheets 1 are held in place.

A metallic listel 38 is placed on the external face of the cushion frames 30 to mask the openings 31. A rib 40 is provided on the cushion frames 30 and the metallic listels 38 are fastened by soldering their two edges 42 along the ribs 40 and along the flange through which the cushion frames are screwed onto frame 2.

The soldering used is a soft soldering, the melting point of which ranges from 100° to 180° C. In order to prevent its infiltration behind listel 38, which would not allow the latter to free itself as rapidly, it is of value to provide the internal face of the listel with a coating which is not wetted by the soldering or even to place therein a separation sheet.

We claim:

1. In a fire-resistant window having at least one glass sheet normal in a main frame disposed about the peripheral edge of the glass sheet with the edge region of the sheet on the side thereof to be exposed to the heating effect of fire being at least partially exposed and free of frame structure, the improvement comprising:

(a) means disposed along the peripheral edge of the glass sheet for securing said sheet to the main frame, said means being disposed to leave the edge region of the sheet sufficiently exposed so that no stresses causing rupture of the glass will occur when the glass sheet is subjected to the heating effect of fire;

(b) listel means disposed over said edge region;

(c) connection means for attaching said listel means to either or both of said glass sheet or frame; and (d) said listel means or connection means or both being constructed of material which in response to the heat of fire changes its physical properties to remove said listel means from said edge region.

2. A window according to claim 1 wherein:
(a) the listel means is made of an inflammable material.
3. A window according to claim 2 wherein:
(a) the listel means is made of a plastic material such as celluloid.
4. A window according to claim 1 wherein:
(a) the listel means is made of light aluminum.
5. A window according to claim 4 wherein:
(a) the connection means loses its efficiency under the effect of heat.
6. A window according to claim 5 wherein:
(a) the connection means is a glue which loses its adhesive qualities under the effect of heat.
7. A window according to claim 5 wherein:
(a) the connection means is a low melting solder having a melting point ranging from about 100° to 180° C.
8. In a fire-resistant window having at least one glass sheet mounted in a main frame disposed about the peripheral edge of the glass sheet with the edge region of the sheet on the side thereof to be exposed to the heating effect of fire being at least partially exposed and free of frame structure, the improvement comprising:
(a) means disposed along the peripheral edge of the glass sheet for securing said sheet to the main frame, said means being disposed to leave the edge region of the sheet sufficiently exposed so that no stresses causing rupture of the glass will occur when the glass sheet is subjected to the heating effect of fire;
(b) listel means disposed within said main frame and over said edge region;
(c) connection means attaching said listel means to said glass sheet, said connection means holding the listel means whereby without it, the listel will fall away from the edge region of the glass sheet; and
(d) the entire connection means being constructed of material which loses its efficiency when exposed to the heating effect of fire to permit the listel means to fall away.
9. In a fire-resistant window having at least one glass sheet mounted in a main frame disposed about the peripheral edge of the glass sheet with the edge region of the sheet on the side thereof to be exposed to the heating effect of fire being at least partially exposed and free of frame structure, the improvement comprising:
(a) cushion frame means disposed along the peripheral edge of the sheet on the side to be exposed to the heating effect of fire for securing said glass sheet to the main frame, said cushion frame being disposed to leave the edge region of the sheet sufficiently exposed so that no stresses causing rupture of the glass will occur when the glass sheet is subjected to the heating effect of fire;
(b) listel means disposed over said edge region and said cushion frame;
(c) connection means attaching said listel means to said cushion frame; and
(d) said listel means or the entire connection means or both being structured of material which, in response to the heat of fire, changes its physical properties to remove said listel means from said edge region.
10. A window according to claim 9 wherein:
(a) the listel is made of an inflammable material which burns away upon being exposed to the heating effect of fire.
11. A window according to claim 9 wherein:
(a) the entire connection means is constructed of material which loses its efficiency upon being exposed to the heating effect of fire.
12. A window according to claim 11 wherein:
(a) the listel is formed of non-flammable material.

* * * * *